US006159101A

United States Patent [19]

Simpson

[11] Patent Number: 6,159,101

[45] Date of Patent: Dec. 12, 2000

[54] INTERACTIVE TOY PRODUCTS

[75] Inventor: Mark Christopher Simpson, Leicestershire, United Kingdom

[73] Assignee: Tiger Electronics, Ltd., Pawtucket, R.I.

[21] Appl. No.: 09/121,506

[22] Filed: Jul. 23, 1998

[30] Foreign Application Priority Data

Jul. 24, 1997 [GB] United Kingdom ..... 9715643
Jul. 24, 1997 [GB] United Kingdom ..... 9715644

[51] Int. Cl.[7] ..... A63F 9/22

[52] U.S. Cl. ..... 463/46; 463/1; 463/36

[58] Field of Search ..... 463/37, 36–38, 463/46, 47

[56] References Cited

U.S. PATENT DOCUMENTS

| | | | |
|---|---|---|---|
| 3,778,058 | 12/1973 | Rausch | 463/3 |
| 4,359,222 | 11/1982 | Smith, III et al. | 463/31 |
| 4,540,176 | 9/1985 | Baer | 463/37 |
| 4,802,879 | 2/1989 | Rissman et al. . | |
| 4,813,907 | 3/1989 | Rissman et al. . | |
| 5,184,830 | 2/1993 | Okada et al. | 463/29 |
| 5,213,327 | 5/1993 | Kitaue . | |
| 5,232,223 | 8/1993 | Dornbusch | 463/37 |
| 5,464,214 | 11/1995 | Griffin . | |
| 5,692,956 | 12/1997 | Rifkin | 463/37 |
| 5,769,682 | 6/1998 | DiResta et al. | 463/32 |
| 5,976,018 | 11/1999 | Druckman | 463/47 |

FOREIGN PATENT DOCUMENTS

| | | |
|---|---|---|
| 0 412 278 A1 | 6/1990 | European Pat. Off. . |
| 2 270 556 | 12/1992 | United Kingdom . |

*Primary Examiner*—Valencia Martin-Wallace
*Assistant Examiner*—John M. Hotaling, II
*Attorney, Agent, or Firm*—Fitch, Even, Tabin & Flannery

[57] ABSTRACT

An interactive toy product including a controller and a casing in the form of a figure having one or more articulated limbs and wherein one or more sensors are provided arranged to detect movement of the one or more limbs and to use such detection as an input to the controller whereby to control at least partially the game playing activity. Preferably, the figure is human or at least anthropoid, and the game program includes means for generating on the screen a display representative of the figure, the program being arranged such that movement of the one or more articulated limbs of the figure generates a corresponding movement of the displayed figure. In another embodiment the interactive toy product is configured as a vehicle having sensors provided to detect movement of one or more elements of the vehicle.

18 Claims, 6 Drawing Sheets

U1
VDD
VSS
ROSC
OSC32I
OSC32 O
SPL60
AUD P
AUD N
RESET
PEF 3
PEF 2
PEF I
PEF O
PEF 4
PEF 5
SO-S39
CO-C15
PCD 3
PCD 2
PCD I
PCD O
I/O DI
I/O D2
200
VCC
202
204
206
208
210
212
214
216
218
220
122
124
126
228
230
LCD DISPLAY
SO-S39
CO-C15
COMMUNICATION DEVICE
240
REMOTE DISPLAY
250

INTERACTIVE TOY PRODUCTS

BACKGROUND OF THE INVENTION

This invention relates to interactive toy products and, in particular, to electronically based products with a screen display under the control of a games program.

For many Centuries, vehicles and human characters have been the inspiration for toys, which have remained universally popular. In past Centuries, dolls and toy horse-drawn vehicles have provided many children with the opportunity of imaginative and creative play; the popularity of toy trains is legendary. In the last Century, the numbers of dolls, toy cars, trucks and similar vehicles sold has exceeded many hundreds of millions. This has been achieved despite the fact that for the majority of this time, the dolls did little more than have movable limbs and the vehicles did little more than run along a predetermined course in a tolerably straight line under the impetus of a push from the user. More recently, energy storage and motor technology has enabled toy vehicles to be self-propelled, and advances in electronics have enabled remotely controllable vehicles which could stop, start and steer to be produced. These have proved to be extremely popular. Vehicle shapes have also been pressed into service in non-toy applications such as cigarette boxes, cigarette lighters, key fobs and computer mice.

In a separate stream of technological development, the last two decades have seen explosive growth in the area of computer games as computer-based equipment became available at affordable prices, and this has resulted in the development of an entire new leisure market. While originally computer games were simply programs which could be loaded into a pre-existing general purpose computer, a market rapidly developed for dedicated games machines, and, in one segment of the market, this led to the development and highly successful commercialization of hand-held computer-based apparatus. This had the major advantage of portability and such apparatus generally consists of a casing enclosing and protecting the electronics and having a screen set in it which is viewed by the user when playing the game. Small, low power consumption screens have been specifically developed for this purpose, and a wide variety of such screens is known.

Control of the game activity is effected by manual actuation of appropriate input devices, for example, press-buttons, a joystick, a roller ball, a mouse or a touch screen, or a combination of any of these. The control of the display is achieved by a combination of sophisticated electronics and programming on the one hand, and the external influence of suitable actuators such as switches, press-buttons and joysticks. Using this general approach, a wide variety of products has appeared on the market and some of them have been highly commercially successful. However, these input devices are general purpose input devices not correlated with the nature of the game activity.

SUMMARY OF THE INVENTION

According to the present invention, there is provided an interactive game unit comprising a casing, a power supply in the case, a microprocessor or like chip and means for controlling a display, preferably one set in the casing itself. In one embodiment, the casing is in the form of a figure having one or more articulated limbs, wherein one or more sensors are provided arranged to detect movement of the one or more limbs and to use such detection as an input to the chip whereby to control at least partially the game playing activity.

Preferably, the figure is human or at least anthropoid, and the game program includes means for generating on the screen a display representative of the figure, the program being arranged such that movement of the one or more articulated limbs of the figure generates a corresponding movement of the displayed figure. Thus, in a simple example, movement of a leg of the figure may cause the corresponding display to appear to kick, such action, for example, resulting in a change of the movement direction of a moving ball being displayed on the screen or, for example, constituting a lethal kick disabling a notional "opponent" in a combat game scenario. The one or more sensors may detect (in combination with the electronics inside the casing) position, movement, or both. The sensors may be simple switches such as button switches, microswitches, or surface area contact pads, or more complex devices such as potentiometers or implants of piezo- or tribo-electric material or any other appropriate types of position or movement detectors.

The microelectronic heart of the device may be a conventional microprocessor-based "game chip" and the programming may be effected by any convenient known means, for example, by having a program stored on the chip, or for example, having a socket mounted in the casing and a plurality of plug-in cartridges or like modules enabling a variety of games to be played depending upon which of a selection of cartridges or modules is inserted. The housing may also include in conventional fashion a battery compartment to provide a supply of power and, if desired, other sensors, for example, button switches or the like, providing increased functionality.

Particularly if a plurality of inputs is available, e.g., from a plurality of limbs, it is preferred to provide means for holding the casing in a fashion leaving the user's fingers free to manipulate the limbs or other sensors such as buttons if provided. Such a support may be, for example, an elasticized strap enabling the device to be held in the palm of the hand with the elasticized strap crossing the back of the user's hand.

An alternative, particularly preferred, arrangement for holding the device in the user's hand where the figure consists of a body and a plurality of articulated limbs attached thereto, includes a holding ring which fixes to and projects from the body of the figure and which can be slipped over one of the fingers of the user, for example, the second or middle finger, with the body on the palm side of the hand. This locates and retains the body and limbs in an appropriate position for manipulation without difficulty by the user's free hand and by the other fingers and the thumb of the hand including the finger on which the holding ring is slipped. In the case of humanoid figures, a highly preferred arrangement is to set the screen in the torso of the figure and provide a holding ring protruding from the back of the figure and in a vertical plane when the figure is "standing up." If desired, the ring may be detachable from its position projecting from the back, and attached (or attachable) to a leash permanently secured to the casing. In a particularly preferred embodiment, the ring is configured as a key ring.

For protection, the screen may be provided with a cover which, if desired, may be configured as a piece of clothing, armor, or other equipment carried by the figure.

It is of particular value to coordinate the game to be played and the action which is displayed on the screen with the figure itself. Thus, for example, if the game is to negotiate a dinosaur through a landscape of various dangers, the figure may be in the form of a dinosaur and the program arranged to display on screen a recognizable representation of the dinosaur. Alternatively, many computer games are based on recognizable "merchandised" characters, for example, Ninja Turtles, Batman, or Mickey Mouse, and the configuration of the casing and limbs may be matched to their conventional representations.

In a particularly preferred embodiment of the present invention, the programming of the chip may enable one of two types of game to be played by the user. In one type of game, the program presents a training or other self-improvement scenario to the user, preferably one appropriate to the nature of the figure itself. Use of the device to play this type of game may lead to two distinct types of improved performance. On the one hand, the manipulative skills of the player may be developed so that he or she operates the limbs with greater facility and accuracy. On the other hand, successful such development may change internally stored parameters which form part of the data which govern the performance of a simulated figure on the screen when playing a combat or competition type of game. In other words, running a "training" program may improve the abilities of the figure in the game or games that the electronic competitor corresponding to the figure may play.

For example, if the electronic version of the figure may play a game or games involving throwing a missile at a target, where accuracy is important, then there may also be provided a training game in which the device may be manipulated so that the electronic version of the figure practices throwing the missile at a target. Use of the training game may thus result in the user of the device getting better at manipulating the device, and/or results in the figure having a better chance of hitting an intended target in a combat or competitive game play scenario.

In one embodiment of the present invention, the device is equipped with an internal clock and the electronic version of the figure may be programmed to lose ability or other attributes if certain training or game playing does not occur over a certain period of time.

In accordance with another embodiment of the invention, there is provided a toy vehicle comprising a casing configured to represent a vehicle, a display screen set in the casing, an electronics package within the casing and connected to the display screen, the electronics package being programmed to enable a game to be played by the user, and a plurality of actuation devices incorporated in the casing and adapted when actuated to control the game play. The electronics package may include a microprocessor or like chip and means for controlling the display.

Preferably the actuation devices are configured as vehicle parts. For example, what appear to be hub caps on the wheels of the toy vehicle may be configured as press-button switches, as may front or rear bumper bars, while a spoiler or aerofoil may be the actuating member for a joystick type of input device.

Preferably, the screen is set, relative to the normal orientation of the vehicle as it were stationary in the normal driving position on a flat surface, in the center of the vehicle horizontally and visible from above. In a particular preferred embodiment, the screen is covered by a detachable cover which, when covering the screen, is shaped and configured as a vehicle roof. In a particularly preferred form, the roof is shaped as a generally hollow shell which, when fitted over the screen, forms an arched roof for a cab or driver and passenger compartment, but with open sides (where side windows could be located in a normal vehicle). Such a shell may be fitted by clipping on to the top of the vehicle and, preferably, it may also be clip fitted to the underside of the vehicle. In this latter position, and provided, of course, that the shell is appropriately dimensioned, the shell forms an arched clip on the underside of the vehicle through which a finger, for example, the middle finger of the hand, may be inserted to enable the vehicle to be held in one hand by a user, the user's other hand being then free to manipulate the actuation units such as hub caps, bumper bars, etc.

In a simple embodiment, the electronics may be programmed, e.g. to simulate a vehicle based game such as a car chase or an obstacle avoidance game. However, in one particular embodiment, and this constitutes a particularly preferred feature of this aspect of the invention, the programming is arranged to include a vehicle maintenance game, which game needs to be played with frequency and regularity if it is to continue working. The "maintenance game" program may be self-contained or form a module of a larger program. Such a program may require the user of the toy to undertake regular "virtual maintenance" on a time scale chosen by the program, which regular maintenance prolongs vehicle life in the sense that the program will continue to operate as long as it has been adequately operated in the past. If, on the other hand, maintenance is neglected, the maintenance game may signal or cause to be displayed on the screen an image of a general deterioration of the condition of the "virtual vehicle" being notionally maintained, and if maintenance is neglected altogether for a sufficient period of time, the electronics may be programmed to render the virtual vehicle unstable. The screen may be programmed to display appropriate warnings of the vehicles imminent demise and, if nothing is done, to display an appropriate image such as that of the vehicle being swallowed by a car-crushing apparatus.

The maintenance game program or program module is operated by the user engaging the actuation device, and in order to enhance realism, these may be coordinated to the various maintenance functions. Thus, a fuel cap may form an actuation button to enable refuelling to occur, and actuation devices in the form of hub caps may correspond to tire or brake related maintenance activities.

If desired, the toy vehicle may be provided with a traction motor conveniently driven by an on-board battery supply which may also power the computer game, and the motor may be controlled by the status of such a car maintenance game. Thus, if the maintenance game has been well played, the motor may be controlled to make the car go faster. More complex strategies can, of course, be adopted.

While the attractions of playing with toy vehicles as such are substantial, so too are the attractions of screen-based computer games played on a home or personal computer. Many such computers have an interface socket enabling signals to be sent to and received from the home computer by an external unit and in yet a further development of the present invention, means may be provided in the toy vehicle to enable it to be functionally connected with a screen-based computer system, such as a personal computer. Such means may conventionally consists of a suitable hard wire connection, but it is also easy to envisage communication between the electronics package in the vehicle and the functional components of the personal computer via wireless means, for example by modulated infrared communication. Whatever the mode of communication, it is possible to provide appropriate programming in the personal computer to interface with the programming in the toy vehicle electronics package to enable, e.g., a car racing game to be played on the personal computer with the operation or performance of the one of the cars appearing on the screen of a conventional computer monitor or television receiver if that is used as a monitor. Game play may depend upon the condition of the toy vehicle, which is being determined by the degree of play which has occurred using the maintenance program and potentially also on the degree of skill in car maintenance acquired by the car maintenance program user.

The degree of sophistication built into such programs may vary very substantially enabling the toy vehicle to be targeted to different age groups while maintaining its ability to provide enjoyable, stimulating and educational play experiences for the user.

BRIEF DESCRIPTION OF THE DRAWINGS

By way of illustration, the invention is described in the attached drawings in which.

DETAILED DESCRIPTION OF THE PREFERRED EMBODIMENTS

Figure 1:
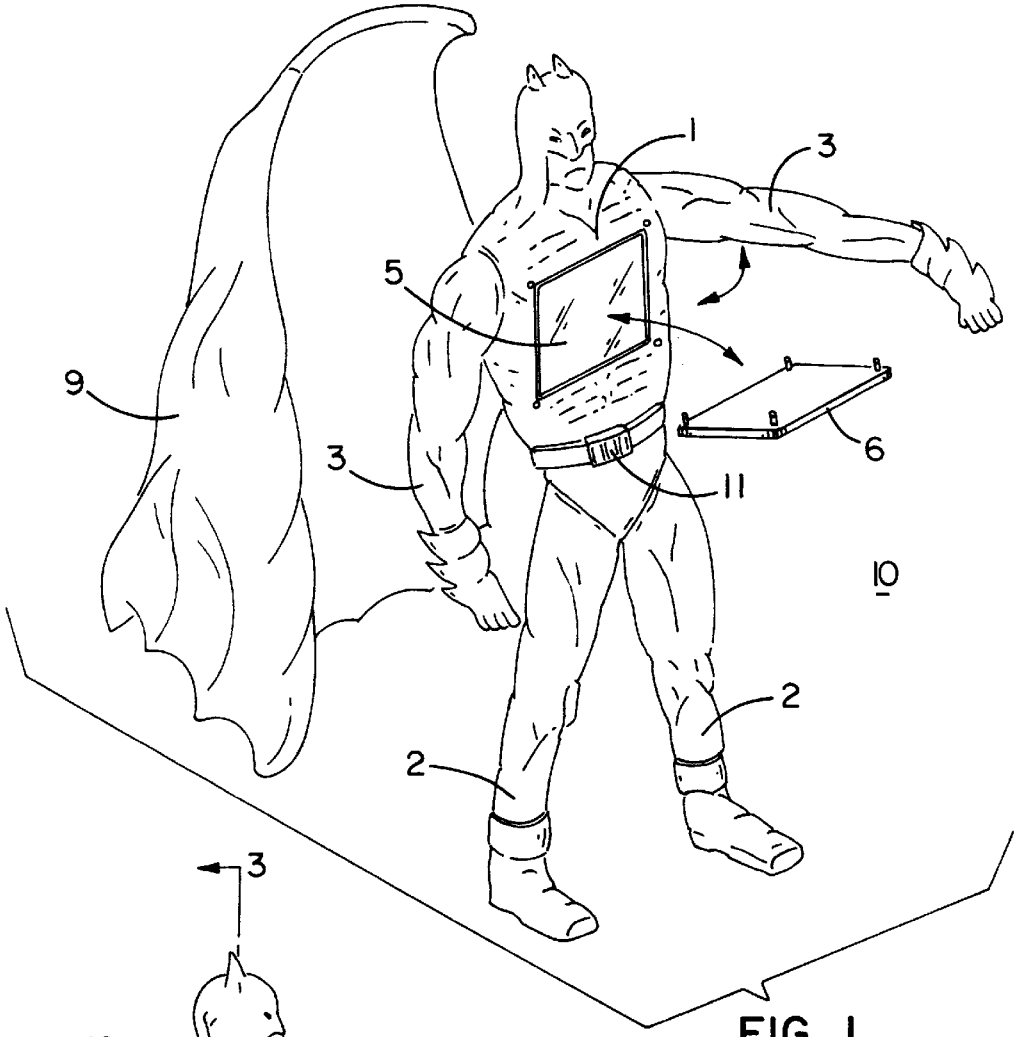
FIG. 1 is a conceptual sketch of a "Batman" figure interactive toy product in accordance with the present invention.

Referring to FIG. 1, a Batman configured play figure 10 consists of a body 1 to which are articulated two legs 2 and two arms 3. The body forms a casing incorporating a display or screen 5, which screen may be concealed when the game is not being played by means of a clip-on breast plate 6. A cloak 9 is provided in customary fashion. Push button 11 located at the figure's belt may be used as a power on/off button or reset button.

Figure 2:
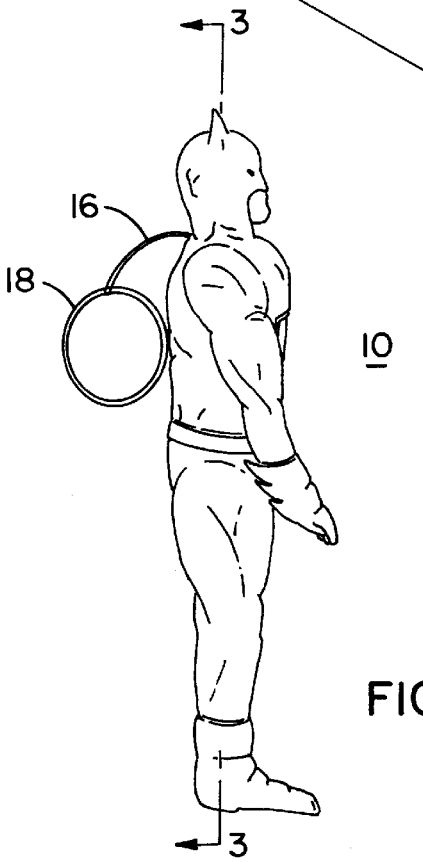
FIGS. 2 is a side view of the "Batman" figure interactive toy product of FIG. 1.

The body 1 contains a battery compartment, a speaker, a game chip (not shown) and the display 5, and additionally contains sensors (not shown) which detect movement of the four articulated limbs 2, 3. The game chip may be an integrated circuit chip or a small printed circuit board including a controller and ancillary electronic components. Protruding from the rear of the body is a ring 18 (which, if desired, may be flat when the game is not being used) which can be slipped over the middle finger of a player's hand for supporting the interactive toy product during play. FIG. 2 is a side view of interactive toy product 10 showing the ring 18 and chain or cord 16 positioned for supporting the toy product during game play.

Figure 4:
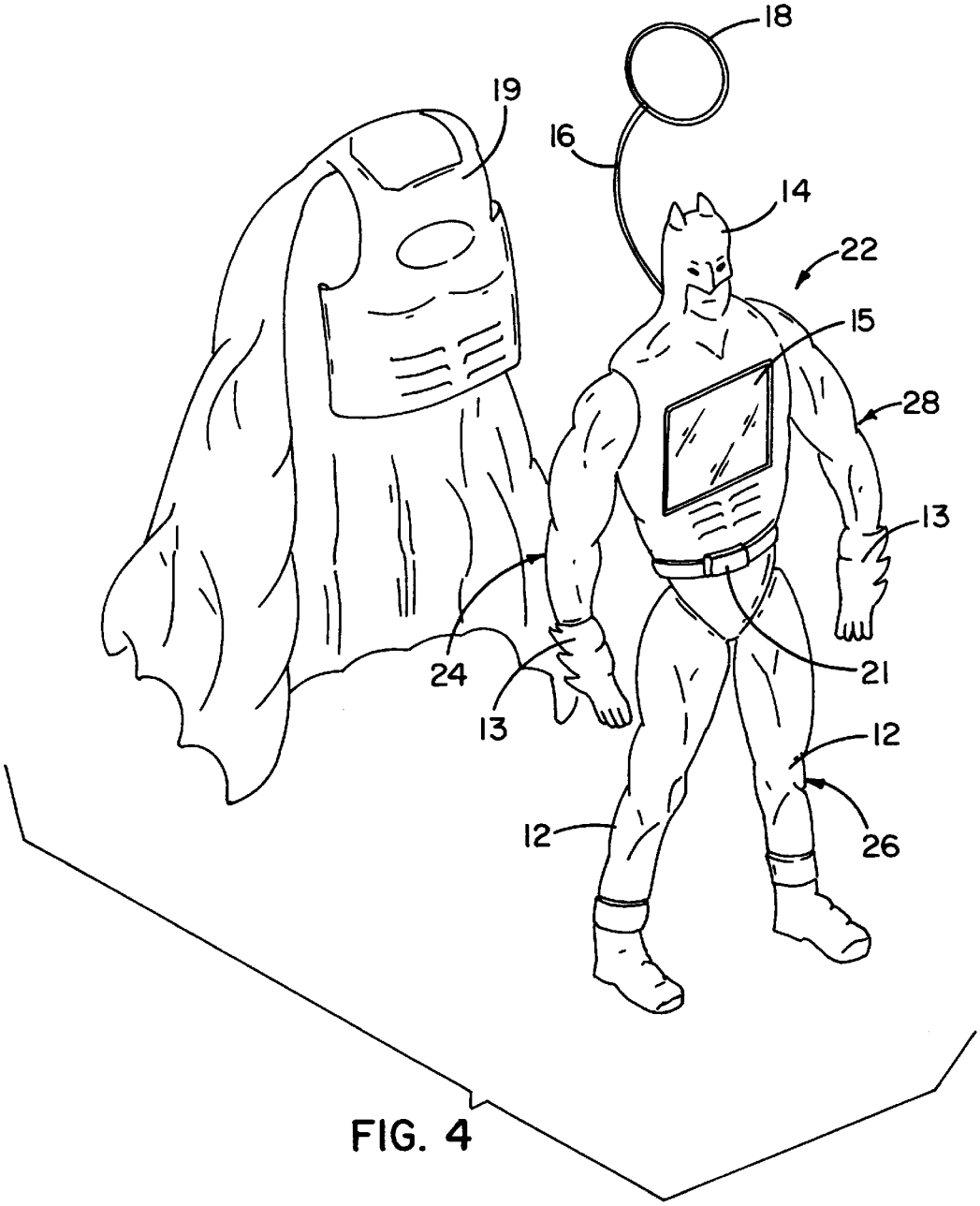
FIG. 4 is an alternate embodiment of the interactive toy product according to the invention.

In the embodiment shown in FIG. 4, the breast plate and cape 19 are formed together and, when removed, expose the display 15. In the embodiment of FIG. 4, the arrows 22, 24, 26 and 28 show the direction the respective limbs 13 and 12 must be pressed to effect movement of the character on the display 15. In this embodiment, the sensors (not shown) are simple contact switches. Head 14 may also activate a switch (not shown) for inputting other aspects of the game. Belt push button 21 may be a power on/off or reset switch.

With appropriate programming and sensor technology (which is straightforward and which is accordingly not described further here), a Batman chase or combat game may be displayed on the screen, the movements of the image of Batman on the screen being controlled by appropriate movements of the limbs relative to the body. The particular interaction between limb movement and the progress of the game can, of course, be varied widely in known fashion by appropriate programming.

The display is preferably an LCD display, but other screens may be used, such as dot matrix.

Figure 3:
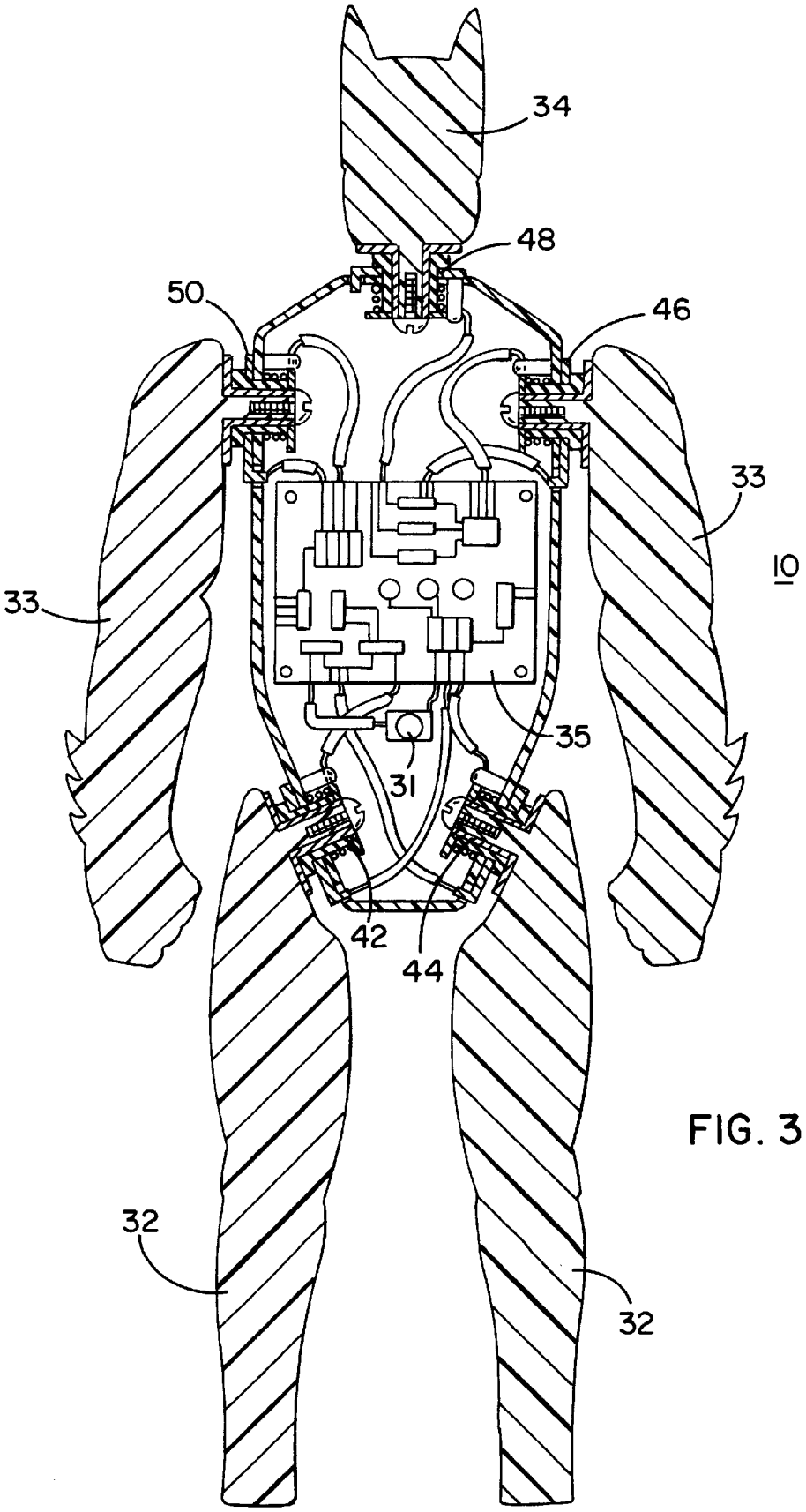
FIG. 3 is a cross-section of the interactive toy product of FIG. 2 along line 3—3.

FIG. 3 is a cross-section of interactive toy product 10 along line 3—3 of FIG. 2. In this embodiment, the sensors are shown as contact switches, where movement of the respective limb or head toward the torso causes the electric contact to be made, which translates to movement of the character on the display. Referring to FIG. 3, arms 33 activate sensors 50 and 46; legs 32 activate sensors 42 and 44; head 34 activates sensor 48. Push button switch 31, located at the belt may provide an on/off function or other programmed functions in accordance with play of the preprogrammed game. Printed circuit board 35 includes the controller and memory for storing the preprogrammed game. Connections for the battery and speaker are also provided, but not shown.

Figure 5:
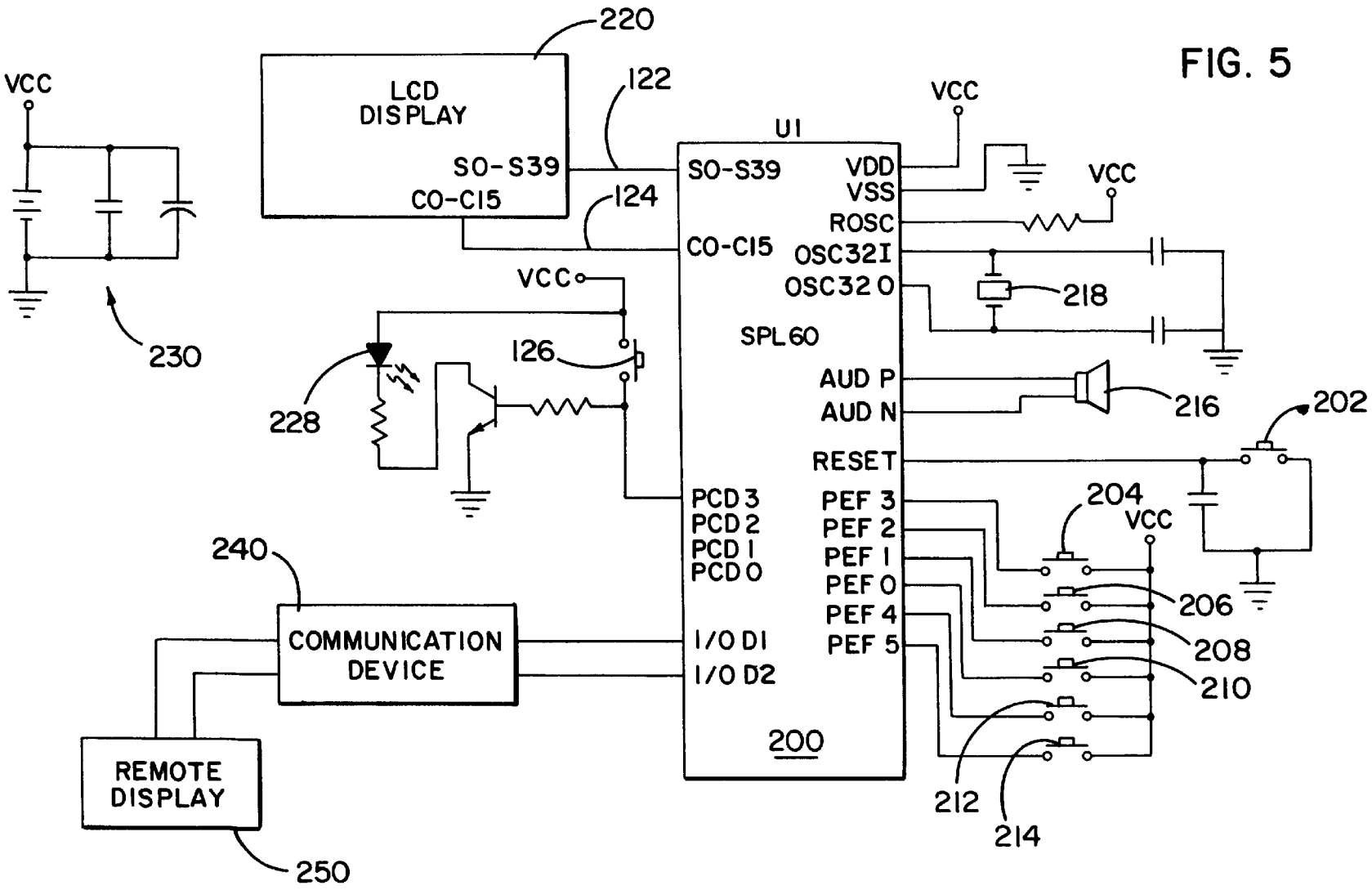
FIG. 5 is a schematic of the electronics for the interactive toy product of FIGS. 1 and 3.
Figure 7:
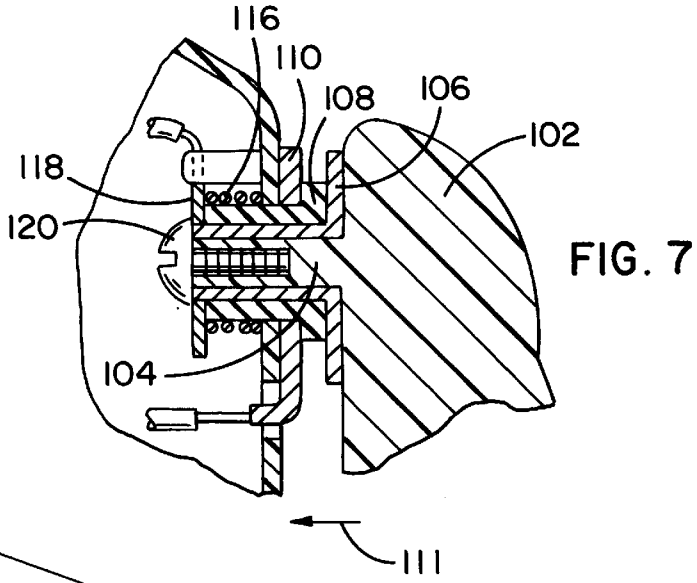
FIG. 7 is a cross-section of the sensor of FIG. 6.
Figure 6:
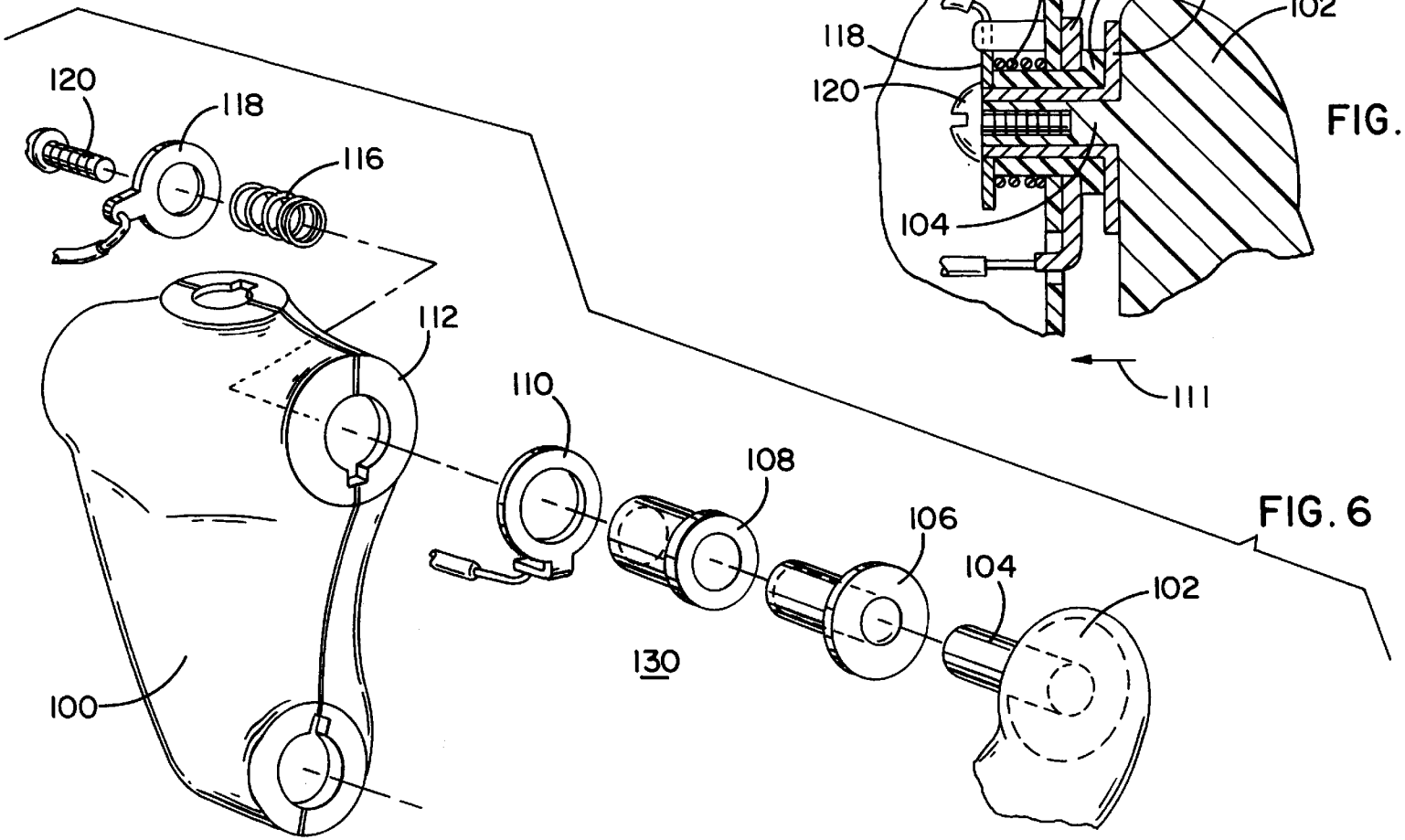
FIG. 6 is an exploded perspective view of the sensor shown in FIG. 3.

Referring to FIGS. 6 and 7, details of the sensors of FIG. 3 are shown with respect to an arm 102. Operation for the other limbs is similar. Arm 102 includes a cylindrical section 104 which fits into brass eyelet 106. Brass eyelet 106 fits into rubber collar 108 which supports tabbed washer 110. Electric wire is soldered to the tabbed ends of tabbed washers 110 and 118 for connection to the controller 200 (See FIG. 5). Tabbed washer 10 fits around rubber collar 108 and butts against the outside of ridge 112 of torso 100. Spring 116 fits around rubber collar 108 and is held in place by tabbed washer 118. Screw 120 screws against tabbed washer 118 into cylindrical section 104 thereby compressing spring 116.

By screwing screw 120 into section 104, electrical contact is made between brass eyelet 106 and tabbed washer 118. Tabbed washer 110 is electrically insulated from tabbed washer 118 by rubber collar 108 and ridge 112 of torso 100. Referring in particular to FIG. 7, the diameter of the upper edge of rubber collar 106 is shorter than the diameters of tabbed washer 110 and the upper portion of brass eyelet 106. Electric contact is achieved by pressing limb 102 into torso 100 in the direction shown by arrow 111. This action compresses rubber collar 108, making the outer edge of brass eyelet 106 (and thus tabbed washer 118 ) electrically contact tabbed washer 110.

The construction of the switches of FIGS. 6 and 7 is beneficial in that it achieves mechanical isolation from arm 102. Thus, the interactive toy product may be played with separately as an action figure with the display cover in place. Arm 102 can be moved in various directions without being encumbered by the electrical contact switch portion. Then, during electronic game play, the arm 102 acts as a pressure switch. Simple activation (pressing the switch or pushing the limb towards the body) achieves action of the virtual character on the screen. Use of the switch provides for faster game play. The interactive toy product becomes two toys: an action figure for creative play by manipulation of the limbs and an interactive virtual action figure on the display which is controlled by actuating limb located switches.

The game is played by manipulating the interactive toy product's limbs, i.e., the two arm and two legs, to effect a response directly relating to the part of the character's body.

In some configurations, additional sensors may be provided, such as those shown in FIG. 4 in which sensors are disposed at both the head and the belt.

The resultant movement is displayed during the game play on the chest-mounted display. For example, if a user depresses the left arm of the interactive toy product, the left arm of the character shown on the display will move its left arm. Specific movement based on the character and type of game play may be programmed. For example, in a fighting character, movement of the left arm will result in a punching or grabbing movement on the screen. Similarly, depressing the right leg of the interactive toy product will make the right leg kick on the screen. Combinations of moves are also possible. Depressing both arms at once for a throw, or both legs to make the character jump.

FIG. 5 is a schematic of the electronic circuitry of the interactive toy product according to the invention. In this embodiment, processor 200 is shown as a microprocessor model SPL60, but it should be apparent to those skilled in the art that processor 200 may also be another digital control device, such as an ASIC, gate array or programmable logic device. Processor 200 controls operation of the various components of the interactive toy product and includes a memory for storing the pre-programmed game and temporary data generated during play of the game. Switches 204, 206, 208, 210, 212 and 214 correspond to the sensors located in the two arms, two legs, head and belt button of the interactive toy product. An optional reset switch 202 resets operation of the game back to the beginning of game play and may be located on the torso portion of the interactive toy product. Sensor inputs are connected to processor 100 at pins PEF0 through PEF 5.

Power is supplied by power supply 230, which is preferably a 3 volt battery. Graphics and text output are displayed on LCD display 220 and controlled via pins S0–S39 and C0–C15. Optional switch 226 turns on LED 228, supplying back light to LCD display 120 via processor input control PC03. Audio output at speaker 216 is controlled through pins AUDP and AUDN. Audio outputs may be in the form of sounds and phrases coordinated with game play. Oscillator 218 provides a signal driving a clock circuit at OSC321 and OSC320. The clock circuit can be used to display time on the display 220 when the interactive toy product is not being used to play the pre-programmed game. I/O ports I/O00 and I/O01 are used for transferring data between the interactive toy product and a remote display 250. An optional communication port may be connected to these pins. The communication port may be connected to a communications device 240, which is then connected to a remote display 250 for displaying play of the preprogrammed game.

Game play for a fighting character can take several stages. In a first stage of play, the character is prepared for battle by building up the character's strength, exercising, providing medical attention at the end of a battle and training in fighting skills. In a second stage of game play, the program creates a computer generated foe on the display. The player must manipulate the interactive toy product's limbs in response to actions by the computer generated foe. More training in the first stage of game play is designed to help the player succeed against the computer generated foe. Game play is similar as in the first stage.

An example of a representative game play, with reference to the interactive toy product of FIGS. 1 or 4 includes the following game play elements. Pressing the central belt button cycles the game between time and game mode. When the game is inactive, it may be programmed preferably to display time of day. Depressing the right leg enables sound effects during game play. Depressing the left leg disables sound effects during game play. To exit or end game play, depress both the head and belt button simultaneously.

The player initiates commands to the displayed character by depressing the sensor activated limbs in the following manner.

| COMBAT FEATURE | DEPRESS LIMB |
|---|---|
| Right Punch | Right Arm |
| Left Punch | Left Arm |
| Right Kick | Right Leg |
| Left Kick | Left Leg |
| Sweep Kick | Both Legs |
| Jump | Head |
| High Attack Right | Head followed by Right Arm |
| High Attack Left | Head followed by Left Arm |
| Throw weapon or shoot right | Hold down Belt Button and Right Leg |
| Throw weapon or shoot left | Hold down Belt Button and Left Leg |

In an alternative embodiment of the present invention, the device of the present invention may include a communication device 240 in addition to, or instead of, a display screen. The communication device may either be hard, such as a plug/socket connection and a wire or cable, or soft, such as an infrared light or ultrasonic emitter with appropriate support electronics. The communication device, when in use, communicates with a remote display or base station 250.

The base station 250 is appropriately equipped to display a game or training scenario on a screen remote from the device, such as the screen of a television, and the manipulation of the device, the details of which manipulation are communicated to the base station by the communication device, causes the playing of the game or training of the figure to be shown on the remote screen. The electronic circuitry and any necessary software for the communication means and the base station are all known and will not be discussed further.

In the embodiment in which the device of the present invention includes both display screen and communication device, the user of the device may view the game on a screen driven by the base station which the user is near the base station, and on the screen built into the device when away from the base station. This has the advantage that a user can thus use the device at any time and any location.

Figure 8:
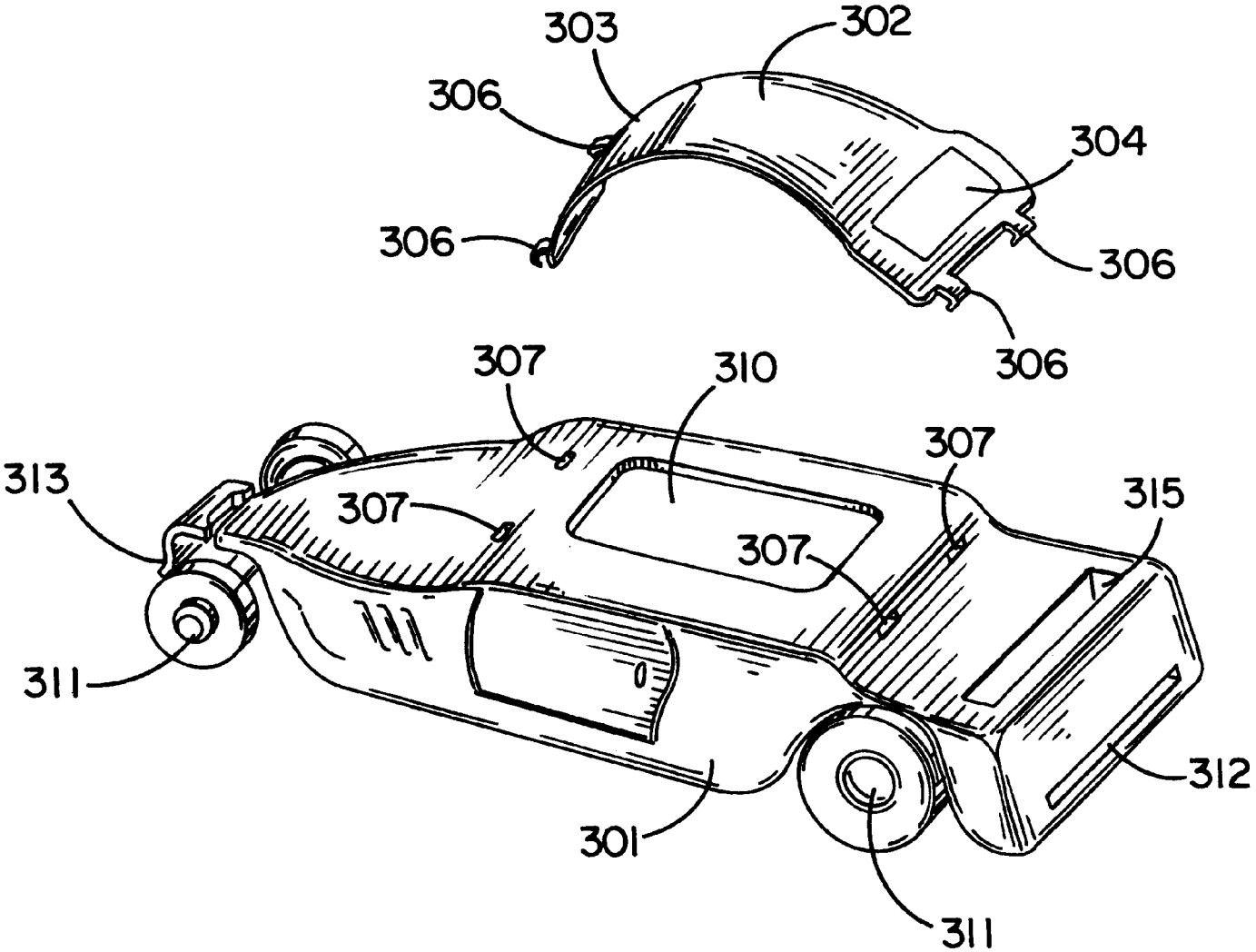
FIG. 8 is a conceptual sketch of a vehicle-shaped interactive toy product in accordance with the present invention.

In the toy vehicle embodiment of the invention, a toy vehicle is diagrammatically shown in FIG. 8. The toy vehicle 300 includes a main body casing portion 301 and a clip-on roof member 302. Inset into roof member 302 are transparent portions simulating a windscreen 303 and a rear window 304.

The clip-on roof 302 has a plurality of tags 306 which are capable of being fitted into recesses 307 on the upper side of casing 301 and which can also be fitted into a matching set of recesses (not shown) on the underside of the casing 301. Thus, the upper roof portion 302 may be detached from the body of the car 300, turned over and reconnected to the underside of the casing where it constitutes a handle by which the overall unit may be held. Alternatively, a ring and cord, as shown in FIGS. 2 and 4 may be used to support the toy vehicle during game play.

When the upper portion of the casing 302 is removed, a visual display screen, for example a liquid crystal display screen 310 becomes visible.

Hub caps 311, a rear bumper bar 312, a front bumper bar 313 and a simulated aerofoil 315 are all configured as actuation members for switches located within the body of casing 301, which switches are electrically connected to a processor 200 (see FIG. 5).

The LCD screen 310 can be divided into different areas in known fashion and can, for example, include preformed icons corresponding to car maintenance tasks. For example, there may be icons representing various parts of the vehicle and by appropriate programming and operation, tasks may be accomplished as part of a maintenance game on those parts of the vehicle. Thus, for example, a maintenance session, which may have to be carried out on a regular basis, may include checking tires for pressure and tread, oil for contamination level as well as sump level, fuel, engine tuning, water level and, e.g., temperature after a simulated run and other factors relevant to the smooth and trouble-free running of a real motor vehicle.

The game program may be arranged to display an initial screen when first actuated by a user giving details of the virtual vehicles performance characteristics and these may be redisplayed at the end of a maintenance session showing appropriate improvements.

Toy vehicle 300 may be connected to a suitable electronic interface in a game playing computer which, when programmed appropriately, can interrogate the electronics package within casing 301 to determine the current condition of the vehicle. That current condition can then be used by the program on the personal computer to form the performance characteristics for a simulated on-screen vehicle, the movement of which may be controlled when, e.g., playing a racing game, by turning the aerofoil 315 appropriately. The aerofoil 315 may be mounted to enable sophisticated control. For example, it may be capable of swivelling about a vertical axis to turn the vehicle in the fashion of a bicycle handlebar and may be rockable about one or two horizontal axes to control speed or acceleration. Alternatively, hubs 311 may be configured to control speed or braking. The program in the personal computer may also be arranged to affect the electronics package internally of the toy vehicle so that, for example, a good performance playing a racing game from a well prepared toy vehicle may be rewarded with enhancements of the toy vehicle's simulated performance, either of a quantitative nature such as making it go faster or of a qualitative one such as providing it with an increased capacity engine, turbo charging, an automatic braking system or in the case of a toy vehicle simulating a high performance racing car, increased downforce-generating aerofoil.

It will be apparent that within the overall scope of the toy vehicle embodiment, a very wide variety of toy vehicles may be produced, which by suitable programming, may provide rewarding and stimulating stand-alone play for their user or the option of a stand-alone play or play in conjunction with a personal computer apparatus, either with a single vehicle with the user playing against the personal computer or with two players, each with a toy vehicle according the to present invention connected to the same computer.

While there have been illustrated and described particular embodiments of the invention, it will be appreciated that numerous changes and modifications will occur to those skilled in the art, and it is intended in the appended claims to cover all those changes and modifications which fall within the true spirit and scope of the invention.

What is claimed is:

1. An interactive game unit for playing a game comprising a casing, a display, a power supply in the casing, and a microprocessor for controlling a display, wherein the casing is in the form of a figure having a torso with one or more articulated limbs and wherein one or more sensors are provided within to detect movement of the one or more limbs and to use such detection as an input to the microprocessor for controlling the game playing activity said torso being engageable with a removeable opaque cover forming a chest plate for covering and protecting the display and for independent use of the figure as a doll.

2. An interactive game unit according to claim 1 in which a display is set in a face of the casing representing the torso of the figure.

3. An interactive game unit according to claim 1 or 2 in which the unit includes a communication means for communication with a base station, the base station being so configured that it operates a display remote from the game unit.

4. An interactive game unit according to claim 3 in which the communication means is in electromagnetic, electrical, or ultrasonic communication with the base station.

5. An interactive game unit according to claim 2 in which the figure is human or at least anthropoid, and the game program includes means for generating a visual presentation on the display representative of the figure, the program being arranged such that movement of the one or more articulated limbs of the figure generates a corresponding movement of the displayed figure.

6. An interactive game unit according to claim 1 in which the microprocessor and means for controlling a display is an integrated circuit mounted inside the casing representing the torso of the figure.

7. An interactive game unit according to claims 1 in which the microprocessor or like chip and means for controlling a display is an integrated circuit mounted inside a cartridge that may be plugged into an appropriate socket mounted in or on a face of the casing representing the torso of the figure.

8. An interactive game unit according to claim 1 in which the game unit has attached to one face of the casing a support means which holds the game unit in position on or in a user's hand.

9. An interactive game unit according to claim 8 in which the support means is a holding ring through which a user may insert a finger.

10. An interactive game unit according to claim 1 in which the microprocessor or like chip and means for controlling a display is programmed with one or more games.

11. An interactive game unit having interactive, preprogrammed game play characteristics, comprising:

a programmable controller for outputting images of a virtual character during operation of a preprogrammed game, the preprogrammed game providing game play for manipulating the virtual character, the virtual character being a figure having a torso portion and a plurality of limbs;

a casing configured to resemble a three-dimensional representation of the virtual character's torso portion;

a plurality of articulated limbs configured to resemble a three-dimensional representation of the virtual character's limbs;

a plurality of sensors for detecting movement of the articulated limbs and for generating input signals for the programmable controller in response to the detected movement;

a display mounted within the casing for displaying images generated during play of the preprogrammed game;

a removable, opaque display cover, said torso being engageable with said display cover for independent use of the figure as a doll;

a memory in communication with the programmable controller, for storing the preprogrammed game, the preprogrammed game causing, upon receipt of an input signal generated in response to a movement of an articulated limb, the programmable controller to generate an image of a corresponding movement of the corresponding limb of the virtual character on the display.

12. The interactive game unit of claim 11 wherein the sensors comprise switches.

13. The interactive game unit of claim 11 wherein the virtual character further comprises a head and further comprising a three-dimensional representation of the virtual character's head and a sensor for detecting movement of the head.

14. The interactive game unit of claim 11 further comprising a support for holding the interactive game unit during play of the preprogrammed game.

15. The interactive game unit of claim 14 wherein the support comprises a ring attached to a chain, the chain being attached to the casing.

16. The interactive game unit of claim 11 wherein the sensors comprise potentiometers.

17. The interactive game unit of claim 11 further comprising a speaker for outputting audio output during play of the preprogrammed game.

18. The interactive game unit of claim 11 the removable cover comprises a three-dimensional representation of an article of clothing of the virtual character.

* * * * *